US005473792A

United States Patent [19]

Kent et al.

[11] Patent Number: 5,473,792

[45] Date of Patent: Dec. 12, 1995

[54] STEAM CLEANING MACHINE

[75] Inventors: Jerry R. Kent, Fresno, Calif.; John Kozul, St. Louis, Mo.; Edwin Fitzwater, Rahway, N.J.

[73] Assignee: Rug Doctor, L.P., Fresno, Calif.

[21] Appl. No.: 368,619

[22] Filed: Jan. 4, 1995

[51] Int. Cl.[6] ..... A47L 7/00

[52] U.S. Cl. ..... 15/320; 15/353; 15/410

[58] Field of Search ..... 15/320, 321, 322, 15/353, 410

[56] References Cited

U.S. PATENT DOCUMENTS

| | | | |
|---|---|---|---|
| 3,408,673 | 11/1968 | Oxel | 15/320 |
| 3,550,181 | 12/1970 | Dolan | 15/320 |
| 3,797,600 | 3/1974 | Miner | 15/320 |
| 3,896,520 | 7/1975 | Williams | 15/320 |
| 3,930,281 | 1/1976 | Principe et al. | 15/320 |
| 3,939,527 | 2/1976 | Jones | 15/353 |
| 3,940,826 | 3/1976 | Phillips et al. | 15/320 |
| 3,974,541 | 8/1976 | Silvis et al. | 15/320 |
| 4,023,233 | 5/1977 | Prestwich | 15/320 |
| 4,138,760 | 2/1979 | Cadle | 15/321 |
| 4,200,951 | 5/1980 | Burgoon | 15/321 |
| 4,317,252 | 3/1982 | Knowlton | 15/320 |
| 4,353,145 | 10/1982 | Woodford | 15/320 |
| 4,458,377 | 7/1984 | Frohbieter | 15/320 |
| 4,586,208 | 5/1986 | Trevarthen | 8/158 |
| 4,651,380 | 3/1987 | Ogden | 15/321 |
| 4,803,753 | 2/1989 | Palmer | 45/320 |
| 4,809,397 | 3/1989 | Jacobs | 15/320 |
| 4,934,017 | 6/1990 | Kent | 15/321 |
| 5,012,549 | 5/1991 | Williams et al. | 15/320 |
| 5,048,148 | 9/1991 | Gleadall | 15/321 |
| 5,146,647 | 9/1992 | Blase et al. | 15/321 |
| 5,155,876 | 10/1992 | Whitaker | 15/320 |
| 5,279,672 | 1/1994 | Betker | 15/320 |
| 5,287,587 | 2/1994 | Yonkers et al. | 15/320 |

FOREIGN PATENT DOCUMENTS

| | | | |
|---|---|---|---|
| 0286328 | 10/1988 | European Pat. Off. | 15/320 |
| 3445200 | 6/1986 | Germany | 15/321 |

*Primary Examiner*—David Scherbel
*Assistant Examiner*—Randall E. Chin
*Attorney, Agent, or Firm*—Grace J. Fishel

[57] ABSTRACT

A steam cleaning machine wherein the clean water tank serves as a chassis for the machine. A main support housing and a recovery tank is mounted on top of the clean water tank which has an upwardly bowed bottom forming a cavity within which is mounted a spray nozzle and a vacuum nozzle. The clean water tank is mounted on wheels, an axle of which passes through the clean water tank. The spray nozzle is mounted on a pan saddled in the cavity and the vacuum nozzle is received in a pair of lateral grooves and a notch formed in the cavity for that purpose.

10 Claims, 5 Drawing Sheets

STEAM CLEANING MACHINE

BACKGROUND OF THE INVENTION

1. Field of the Invention

The present invention relates to a steam carpet and upholstery cleaning machine wherein the number and size of the parts have been reduced and wherein many of the parts serve several purposes.

2. Brief Description of the Prior Art

A steam cleaning machine for carpets typically includes a clean water tank and a recovery tank. A clean water hose joins the clean water tank to a pump and spray nozzle and a vacuum hose extends from a vacuum nozzle to the recovery tank. Water is pumped from the clean water tank and supplied to the spray nozzle and a large blower on the recovery tank generates suction whereby water sprayed onto the carpet is drawn through the vacuum nozzle and vacuum hose into the recovery tank. A brush for scrubbing the carpet may also be provided.

In older steam cleaners, the clean water tank and recovery tank were mounted on a first carriage and the spray nozzle and vacuum nozzle were mounted on a second carriage. More recently, carpet steam cleaners have mounted the spray nozzle and vacuum nozzle on the same carriage as the clean water tank and recovery tank. Such all-in-one machines are less bulky and cumbersome to transport and use, one such machine being sold by Rug Doctor, L. P. under the trademark EZ-1.

The EZ-1 has been redesigned, reducing the number and size of the parts and making them serve multiple purposes. The resulting machine has 40–50% fewer parts and is less expensive to manufacture because of materials reduction and because it is easier to assemble. The resulting machine is small, compact, well balanced and light weight, yet has better recovery efficiency than the older model. In addition, the equipment is as maneuverable as the wand on the much earlier two-piece steam cleaners, an advantage they had over all-in-one cleaners up until now, in its ability to get under and around furniture without rearranging and disrupting the setting, allowing the operator to concentrate on the task of cleaning the carpet.

The focus of this application regards a number of features that have been molded into a clean water tank, reducing the height of the machine and improving its balance. More particularly, on the bottom of the clean water tank is mounted an axle for the wheels, a vacuum nozzle and a pan upon which is mounted a spray nozzle, water pump and vibrating brush assembly. On top of the clean water tank is mounted a main support housing for a vacuum motor and a recovery tank.

SUMMARY OF THE INVENTION

In view of the above, it is an object of the present invention to provide a small, compact, well balanced, light weight all-in-one steam cleaning machine. It is another object to provide an all-in-one steam cleaning machine that has better recovery efficiency. It is also an object to provide an all-in-one steam cleaning machine with fewer parts that is less expensive to manufacture. Other objects and features of the invention will be in part apparent and in part pointed out hereinafter.

In general terms, a steam cleaning machine in accordance with the present invention has a vacuum head mounted on a main support housing, a removable waste recovery tank that is slidable in and out of the main support housing and a clean water tank. The clean water tank has a top, a bottom, front, rear and side walls with the main support housing and recovery tank mounted on the top. The bottom of the clean water tank is upwardly bowed towards the top on the inside of the tank, forming a cavity on the outside of the tank within which is saddled a pan upon which is mounted a spray nozzle and a water pump. Wheels are attached to the bottom of the clean water tank and a vacuum nozzle is mounted in the cavity forward of the spray nozzle. Clean water is drawn from the clean water tank by the water pump which is connected to the spray nozzle and dirty water is drawn through the vacuum nozzle by the vacuum motor which is connected to the recovery tank. The invention summarized above comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
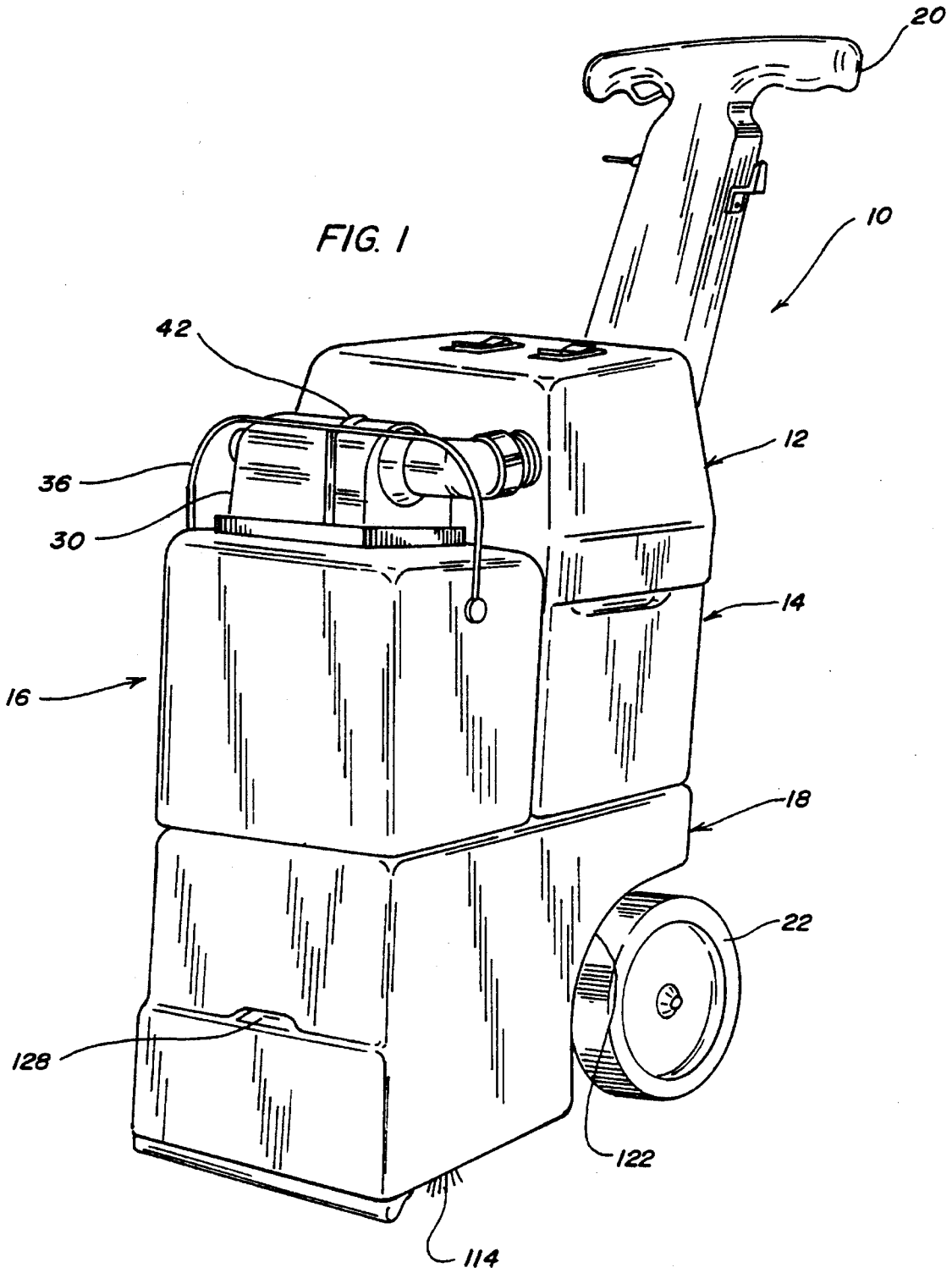
FIG. 1 is a perspective view of a steam cleaning machine in accordance with the present invention.
Figure 2:
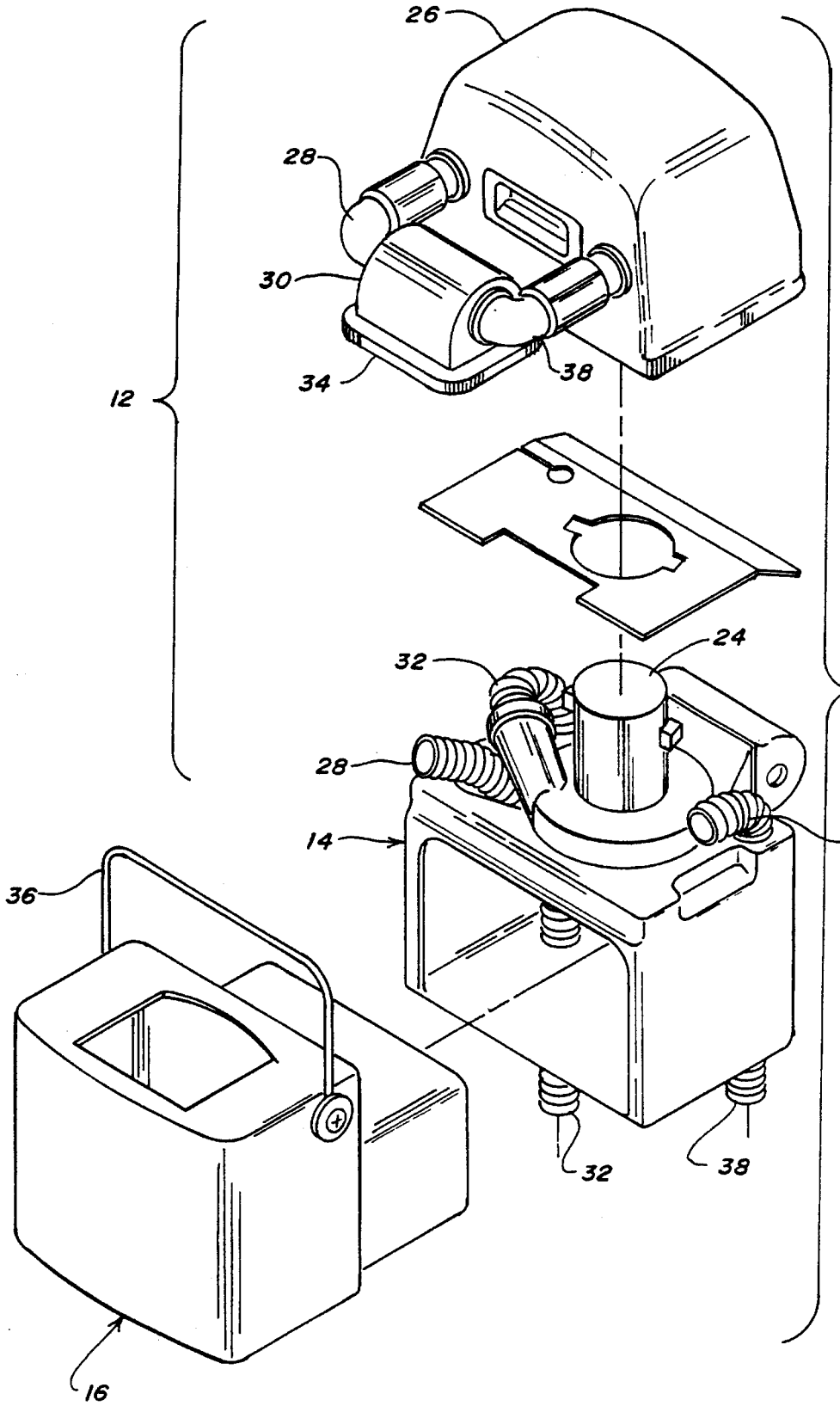
FIG. 2 is an exploded view of a vacuum head, main support housing and waste recovery tank.
Figure 3:
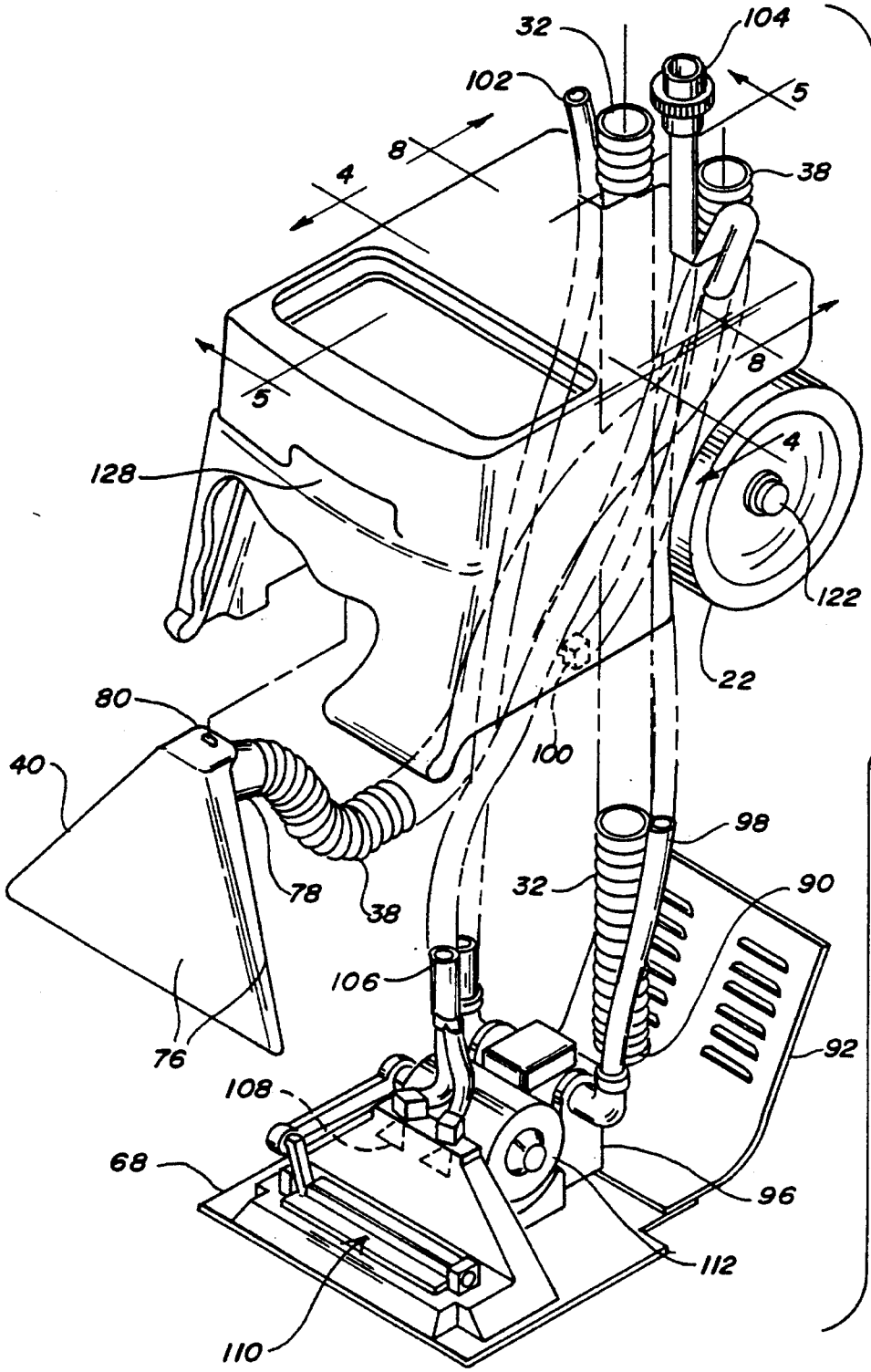
FIG. 3 is an exploded view of a clean water tank, vacuum nozzle, spray nozzle and vibratory bush assembly.

Referring to the drawings more particularly by reference character, reference numeral 10 refers to a portable self-contained carpet steam cleaning machine in accordance with the present invention. Steam cleaner 10 includes, vertically stacked, a vacuum head 12 mounted on a main support housing 14, a removable waste recovery tank 16 slidable in and out of the main support housing and mounted under the vacuum head 12, and a bottom clean water tank 18 upon which the main support housing and waste recovery tank are mounted. A handle 20 is pivotally attached to main support housing 14 at the rear of the machine for moving the machine on a pair of wheels 22 attached to the underside of clean water tank 18, which in addition to serving as a reservoir for premixed cleaning solution, serves as a chassis for the machine.

Vacuum head 12 includes a vacuum pump or motor 24 housed under a vacuum cover 26 that is attached to main support housing 14. The air inlet side of vacuum motor 24 is attached to a first conduit 28 which passes through an aperture in vacuum cover 26 and connects to one side of a dome 30, while the exhaust side of vacuum pump 24 is attached to a second conduit 32 that passes down the back of the machine. Dome 30 has a gasket 34 about its base and is sealed about an aperture in the top of recovery tank 16. The seal between dome 30 and recovery tank 16 is maintained by a bale 36 that doubles as a carrying handle for recovery tank 16. A third conduit 38 in communication with recovery tank 16 is attached to the other side of dome 30 and passes through a second aperture in vacuum cover 26. The vacuum in first conduit 28 is communicated through recovery tank 16 to third conduit 38, which passes down the back of the machine and is coupled to a vacuum nozzle 40 under clean water tank 18. Third conduit 38 is separated from first conduit 28 by a vertical partition 42 for preventing the entry of water into the vacuum motor.

Figure 4:
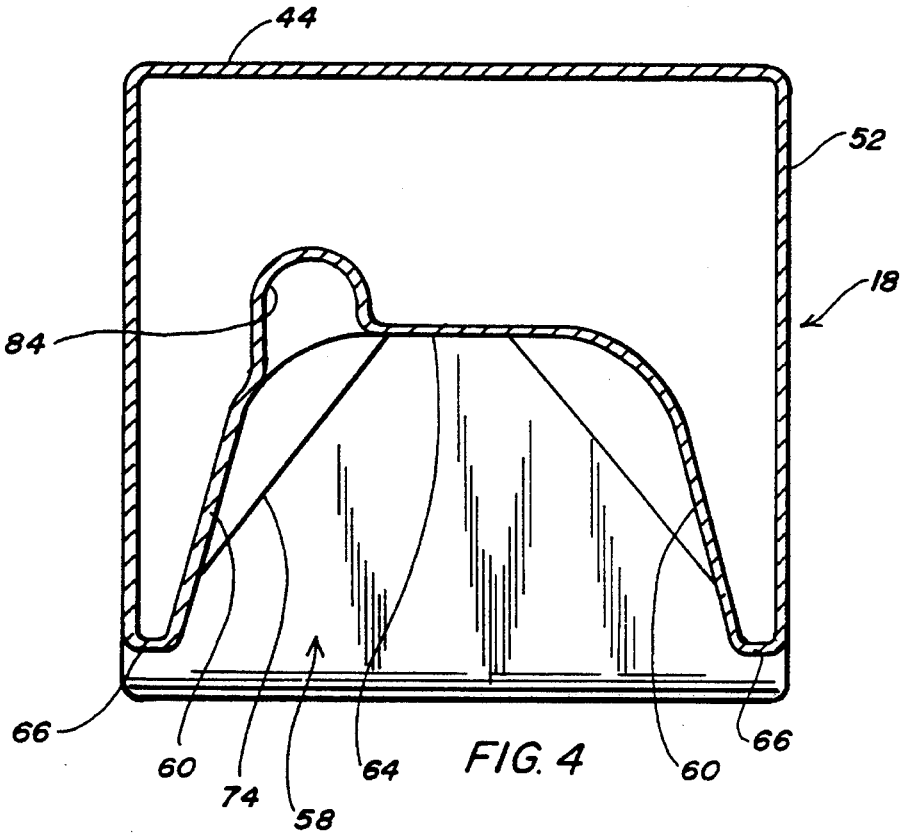
FIG. 4 is a section taken along line 4—4 in FIG. 3.
Figure 5:
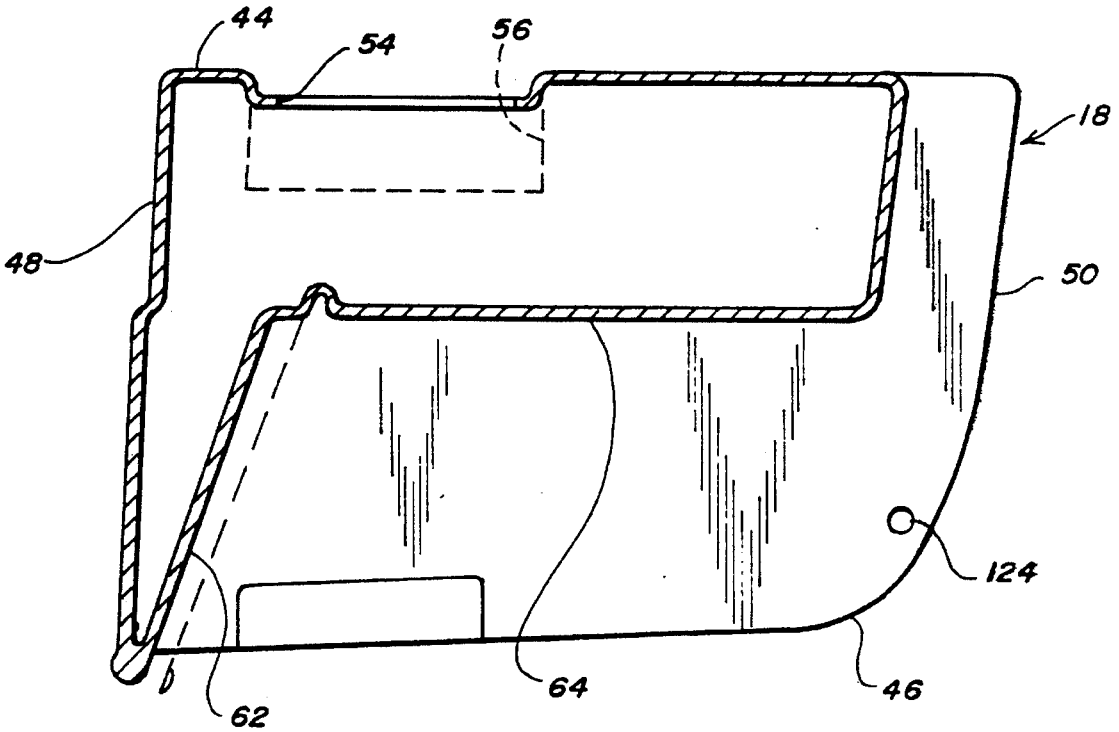
FIG. 5 is a section taken along line 5—5 in FIG. 3.
Figure 6:
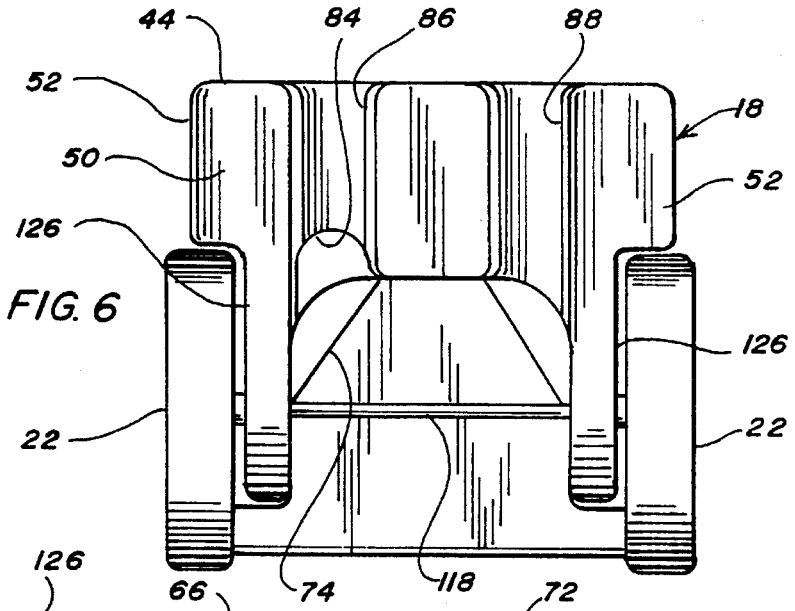
FIG. 6 is a rear view of the clean water tank with a pan and rear panel removed.
Figure 8:
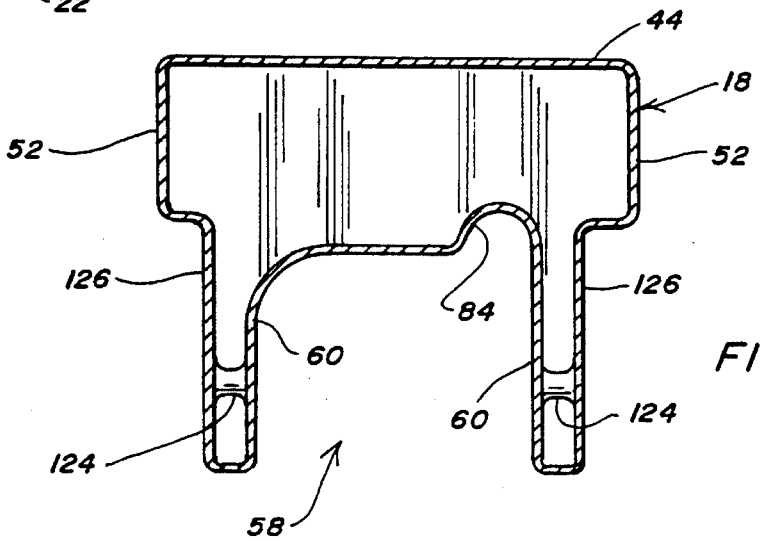

Clean water tank 18 is generally rectangular in configuration with a top and bottom, 44, 46, and front, rear and lateral side walls 48, 50 and 52, respectively. Top 44 includes an aperture 54 at the front of the tank for use in filling the tank with premixed cleaning solution. A screen insert 56 is provided in aperture 54 for the propose of keeping sand and other debris out of clean water tank 18. Bottom 46 of clean water tank 18 is upwardly bowed on the inside of the tank towards top 44, forming a cavity 58 on the outside of the tank with side walls 60, a front wall 62 and a top 64. Cavity 58 is open opposite top 64 and front wall 62. As best seen in FIGS. 4 and 8, side walls 60 of cavity 58 are spaced from side walls 52 of tank 18 along a lower edge thereof with bottom 46 providing a pair of flat surfaces 66 for attachment of a pan 68 with screws. Front wall 48 of clean water tank 18 is slightly longer than side walls 52 and is flared downwardly and forwardly so that the front end of machine 10 can be brought flush with the base of walls and furniture. A pair of lateral grooves 72 are provided in side walls 60. Front wall 62 of cavity 58 is also flared downwardly and forwardly but at a steeper angle than front wall 48, providing a flat abutment surface with a notch 74 for receipt of vacuum nozzle 40.

Vacuum nozzle 40 includes a pair of spaced triangular plates 76, joined on two sides and open on the bottom, the rear plate of which has a fitting 78 for attachment to third conduit 38. Vacuum nozzle 40 has an ear 80 and is held in grooves 72 with a single screw. Top 64 of cavity 58 has a hollow 84 extending into a notch 86 up rear wall 50 of clean water tank 18 for receipt of third conduit 38. A second notch 88 is provided in rear wall 50 for receipt of second conduit 32 which is vented at 90 through a rear panel 92. Rear panel 92 is attached to pan 68 and rear wall 50 of clean water tank 18 with screws.

A water pump 96 is mounted on pan 68. An inlet of water pump 96 is connected by a first tube 98 to a strainer 100 in the bottom of clean water tank 18 and an outlet is connected by a second tube 102 to a male portion of a quick disconnect coupler 104 that is accessed from the rear of the machine. A third tube 106 interconnects a female portion of coupler 104 and a spray nozzle 108. Water pump 96 and spray nozzle 108 are mounted on pan 68 and are fitted under clean water tank 18. A vibrating brush assembly 110 including a motor 112 for oscillating a brush 114 with a cam driven link may also be mounted on pan 68.

Figure 7:
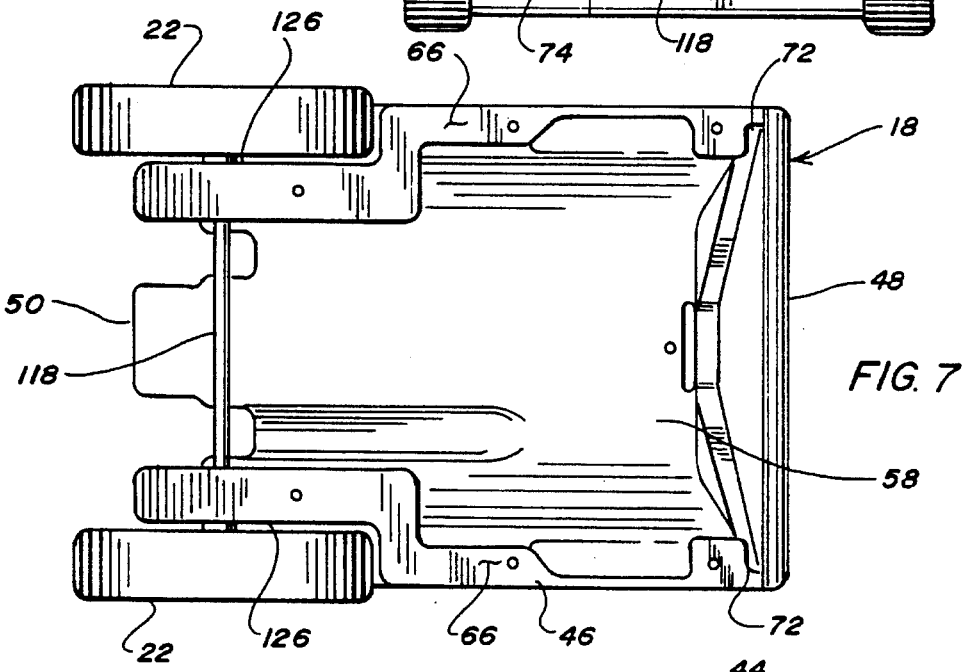
FIG. 7 is a bottom view of the clean water tank with the pan and rear panel removed; and, FIG. 8 is a section taken along line 8—8 in FIG. 3.

Wheels 22 are mounted on a stationary axle 118 using a standard mounting arrangement with an axle cap 122. Axle 118 is contained in a pair of aligned sleeves 124, passing through and connecting side walls 52 of the tank and side walls 60 of the cavity, molded in clean water tank 18. The sleeves support the axle and attach the wheels to the underside of clean water tank 18. As best seen in FIG. 7, side walls 52 of the tank and side walls 60 of the cavity take a dogleg at the rear of the machine to form a recess 126 for wheels 22 such that the wheels are partially recessed in clean water tank 18. A hand hold 128 may also be molded into the outside of front wall 48 of clean water tank 18.

In use, as machine 10 is pulled rearwardly on wheels 22 by handle 20, premixed cleaning solution is drawn through strainer 100 in clean water tank 18 through first tube 98 into the inlet of water pump 96. The cleaning solution is then forced from the outlet of water pump 96 into second tube 102 which mates with third tube 106 at coupler 104 and delivered under pressure to spray nozzle 108. Spray nozzle 108 directs a spray of the solution onto a carpet just behind vibratory brush assembly 110. The wetted carpet is given a brief scrubbing and the cleaning solution immediately recovered with vacuum nozzle 40. Spent cleaning solution is sucked through conduit 38, into dome 30, where it is stopped by partition 42 and falls under gravity to the bottom of recovery tank 16.

The features molded into clean water tank 18 allow it to function as a chassis for the machine in addition to serving as a reservoir for the clean solution. Clean water tank 18 is a base for the main support housing, an axle box for the axle and a support for the vacuum nozzle and the pan upon which is mounted the spray nozzle, associated pump, vibrating brush assembly, etc. In the older model, the clean water tank only served as a reservoir.

By molding in the above features, the number of parts is greatly reduced, reducing assembly time and materials cost. The machine is made more compact. The distance between vacuum nozzle 40 and vacuum head 12 is shortened, reducing the length of the vacuum tract, which improves recovery efficiency (i.e., the amount of cleaning solution recovered from the carpet) while decreasing vacuum motor requirements.

The weight of the machine is reduced, while balance and maneuverability improved. With the unit vertically stacked and wheels 22 mounted under clean water tank 18, the center of gravity is shifted towards axle 114. This, in combination with the adjustable handle, permits the operator to adjust the handle to his or her height, allows the machine to be pulled easily, such that the operator has no tendency to lift the machine on the rearward stroke to maintain suction at vacuum nozzle 40, making the machine less tiring to use.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A cleaning machine comprising a vacuum head mounted on a main support housing, a removable waste recovery tank mounted under the vacuum head and slidable in and out of the main support housing, a clean water tank, a spray nozzle connected to the clean water tank for spraying water on a carpet, a water pump for pumping clean water from the clean water tank to the spray nozzle, and a vacuum nozzle connected to the vacuum head for drawing water sprayed on a carpet by the spray nozzle into the recovery tank, said clean water tank having a top, a bottom, and front, rear and side walls, said removable waste recovery tank and main support housing mounted on the top of the clean water tank, said bottom of the clean water tank upwardly bowed towards the top on the inside of the tank, said upwardly bowed bottom forming a cavity on the outside of the tank within which is mounted the vacuum nozzle and within which is saddled a pan upon which is mounted the spray nozzle and the water pump.

2. The cleaning machine of claim 1 wherein the cavity has a top, a front and side walls and is open opposite the top and front walls.

3. The cleaning machine of claim 2 wherein the side walls of the cavity are spaced from the side walls of the clean water tank along a bottom edge of the clean water tank providing a flat surface for attachment of the pan.

4. The cleaning machine of claim 3 further comprising a pair of aligned sleeves passing through and connecting the side walls of the clean water tank and the side walls of the cavity, said aligned sleeves mounting an axle therethrough having a pair of wheels mounted on the axle.

5. The cleaning machine of claim 4 wherein a hand hold is formed in the outside of the front wall of the clean water tank.

6. A cleaning machine comprising a vacuum head mounted on a main support housing, a removable waste recovery tank mounted under the vacuum head and slidable in and out of the main support housing, a clean water tank, a spray nozzle connected to the clean water tank for spraying water on a carpet, a water pump for pumping clean water from the clean water tank the spray nozzle, and a vacuum nozzle connected to the vacuum head for drawing water sprayed on a carpet by the spray nozzle into the recovery tank, said clean water tank having a top a bottom and front, rear and side walls, said removable waste recovery tank and main support housing mounted on the top of the clean water tank, said bottom of the clean water tank upwardly bowed towards the top on the inside of the tank, said upwardly bowed bottom forming a cavity on the outside of the tank within which is saddled a pan upon which is mounted the spray nozzle and the water pump and within which is mounted the vacuum nozzle, said cavity having a top, and front and side walls and being open opposite the top and front walls, said front wall of the clean water tank being longer than the side walls of the clean water tank and flared downwardly and forwardly, said front wall of the cavity flared downwardly and forwardly at a steeper angle than the front wall of the clean water tank.

7. The cleaning machine of claim 6 wherein the vacuum nozzle is triangular, the side walls of the cavity have a pair of lateral grooves adjacent the front wall of the cavity and the front wall of the cavity has a notch for receipt of the vacuum nozzle.

8. The cleaning machine of claim 7 wherein the top of the cavity has a hollow for receipt of a vacuum hose connected to the vacuum nozzle.

9. The cleaning machine of claim 8 wherein the side walls of the cavity are spaced from the side walls of the clean water tank along a bottom edge of the clean water tank providing a flat surface for attachment of the pan.

10. The cleaning machine of claim 9 further comprising a pair of aligned sleeves passing through and connecting the side walls of the clean water tank and the side walls of the cavity, said aligned sleeves mounting an axle therethrough having a pair of wheels mounted on the axle.

* * * * *